US007588292B2

(12) United States Patent
Valdes et al.

(10) Patent No.: US 7,588,292 B2
(45) Date of Patent: Sep. 15, 2009

(54) GARDENING CHAIR HAVING MOVABLE SUPPORT SURFACE

(76) Inventors: Omar P. Valdes, 1026 E. Carob Ave., Reedley, CA (US) 93654; Christina C. Valdes, 1026 E. Carob Ave., Reedley, CA (US) 93654

( * ) Notice: Subject to any disclaimer, the term of this patent is extended or adjusted under 35 U.S.C. 154(b) by 0 days.

(21) Appl. No.: 11/821,735

(22) Filed: Jun. 25, 2007

(65) Prior Publication Data

US 2008/0315651 A1 Dec. 25, 2008

(51) Int. Cl.
*A47C 3/16* (2006.01)
*A47C 1/00* (2006.01)
*A47C 16/02* (2006.01)

(52) U.S. Cl. ..... 297/313; 297/314; 297/423.41; 297/423.43; 297/423.44; 297/423.45; 297/423.46

(58) Field of Classification Search ..... 297/423.41, 297/423.43, 423.44, 423.46, 313, 423.45, 297/314
See application file for complete search history.

(56) References Cited

U.S. PATENT DOCUMENTS 186,071 A * 1/1877 White ..... 297/423.45 X
269,780 A * 12/1882 Fenny ..... 297/423.46
322,792 A * 7/1885 Clark ..... 297/423.41
663,632 A * 12/1900 Mack ..... 297/423.46
789,813 A * 5/1905 Longley ..... 248/396
815,046 A * 3/1906 Sherman ..... 297/188.01
2,017,433 A * 10/1935 Carrington ..... 248/146
2,248,369 A * 7/1941 Ludersen ..... 248/371
2,281,119 A * 4/1942 Smith ..... 297/423.46
2,353,418 A * 7/1944 Smith ..... 297/118
2,528,331 A * 10/1950 Bell ..... 297/423.46
2,600,759 A * 6/1952 Gross ..... 297/423.44 X
2,798,732 A * 7/1957 Craig ..... 297/423.41 X
D182,750 S * 5/1958 Williams ..... D6/353
2,850,081 A * 9/1958 Dillon ..... 297/423.41
2,869,620 A * 1/1959 Gleitsman ..... 248/397
2,907,375 A * 10/1959 Gleitsman et al. ... 297/423.46 X
2,912,046 A * 11/1959 Fuerst ..... 297/423.46 X
2,994,364 A * 8/1961 Gleitsman et al. ..... 297/423.46
3,119,356 A * 1/1964 Sauer ..... 297/423.44 X
3,121,551 A * 2/1964 Ancell et al. ..... 297/423.44 X
3,132,835 A * 5/1964 Drabert ..... 297/423.46 X
3,143,375 A * 8/1964 Langbaum ..... 297/423.46
3,160,381 A * 12/1964 Langbaum ..... 297/423.46 X
3,163,468 A * 12/1964 Koch ..... 297/423.46
3,438,675 A * 4/1969 Seguin et al. ..... 297/423.43
3,563,605 A * 2/1971 Pinkas ..... 297/423.43

(Continued)

FOREIGN PATENT DOCUMENTS

DE 3432303 A1 * 3/1985

*Primary Examiner*—Rodney B White
(74) *Attorney, Agent, or Firm*—Raymond M. Galasso; Galasso & Associates, LP

(57) ABSTRACT

A gardening chair configured to facilitate increase access to the area proximate thereto for a user. The gardening chair further includes a stationary base that is configured to provide structural support. Pivotally attached to the base is a sitting platform configured to receive a user thereon. Pins are utilized to pivotally connect the sitting platform and the base. The gardening chair further includes two pivot pins mounted to the sitting platform functioning to engage with the base and control the amount of pivotal movement of the sitting platform.

12 Claims, 2 Drawing Sheets

U.S. PATENT DOCUMENTS 3,667,803 A * 6/1972 Ford ..... 297/423.44 X
3,940,181 A * 2/1976 Cheek, Jr. ..... 297/423.46
4,427,234 A * 1/1984 Peters ..... 297/423.45
4,441,758 A * 4/1984 Fleischer et al. ..... 297/423.46
4,549,767 A * 10/1985 Hampshire et al. ..... 297/423.46
4,873,966 A * 10/1989 Gitter ..... 297/423.43 X
4,901,385 A * 2/1990 Adolphson ..... 297/423.46 X
5,054,144 A * 10/1991 Stuart et al. ..... 297/423.44 X
5,201,568 A * 4/1993 Christensen, Jr. ..... 297/423.46
5,238,296 A * 8/1993 Paul ..... 297/423.43
5,294,180 A * 3/1994 Grimm ..... 297/423.44
5,348,377 A * 9/1994 Grosch ..... 297/423.46 X
5,356,203 A * 10/1994 Levasseur et al. ..... 297/423.45
5,419,618 A * 5/1995 Hatcher ..... 297/423.46
5,536,072 A * 7/1996 Chang ..... 297/423.45
5,577,806 A * 11/1996 Ugalde ..... 297/423.46
5,584,535 A * 12/1996 Jacobson et al. ..... 297/423.46
5,626,393 A * 5/1997 Levasseur et al. ..... 297/423.46
6,682,147 B1 * 1/2004 Leoutsakos ..... 297/423.41
6,846,043 B1 * 1/2005 Leoutsakos ..... 297/423.46
2003/0071508 A1 * 4/2003 Lu ..... 297/423.43

* cited by examiner

GARDENING CHAIR HAVING MOVABLE SUPPORT SURFACE

FIELD OF THE INVENTION

The present invention relates to a sitting aid, more specifically a chair having a base and a support structure with the support being pivotally secured to the base to facilitate a increase user's ability to reach objects in an area proximate the chair.

BACKGROUND

Home improvement is a multi-billion dollar a year industry in the United States. Homeowners engage in many facets of home improvement. One area of home improvement that millions of homeowners engage in is gardening or landscaping. Homeowners routinely plant trees, shrubs and utilize flower beds to create a desired look around their home.

Whether it is the maintenance of existing landscaping or gardens or the installation of new foliage, routinely this type of work involves a great deal of time that is usually spent on the ground in a bent over position. Homeowners routinely remain in one position while they work in the area proximate to them within their reach performing the necessary tasks that are needed to accomplish the gardening or landscaping project. This usually involves forward movement of their torso outside of its general axial alignment, or rested position, as well as reaching in the proximate area with their arms. These movements can create a significant amount of discomfort for any individual engaging in these tasks for a long period of time. One problem in performing these tasks is that a user is required to constantly move as they perform work in the area proximate to them. While there are many current devices that provide a user a suitable horizontal support structure to engage with while performing gardening or landscaping task, no current device has been shown the ability to increase the area in which a user can work in without having to move.

Accordingly, there is a need for a device that can provide a suitable support structure for a user to engage therewith while performing tasks such as gardening or landscaping that can increase the area in which a user can reach without the requirement for moving the support structure.

SUMMARY OF THE INVENTION

It is the object of the present invention to provide a support structure for a user to engage therewith during such tasks as gardening for providing an ability to substantially increase the area in which the user can perform tasks in without the requirement for moving the support structure.

Another object of the present invention to provide a support structure for use in performing tasks such as gardening that comprises a base portion and a top portion.

A further object of the present invention is to provide a support structure wherein the top portion is pivotally secured to the base portion facilitating movement thereof.

Yet another object of the present invention is to provide a support structure having a pivotal top portion that has the ability to pivot up to twenty five degrees.

It is a further object of the present invention to provide a support structure for use in tasks such as gardening that is light weight and inexpensive.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawing wherein:

DETAILED DESCRIPTION

Figure 1:
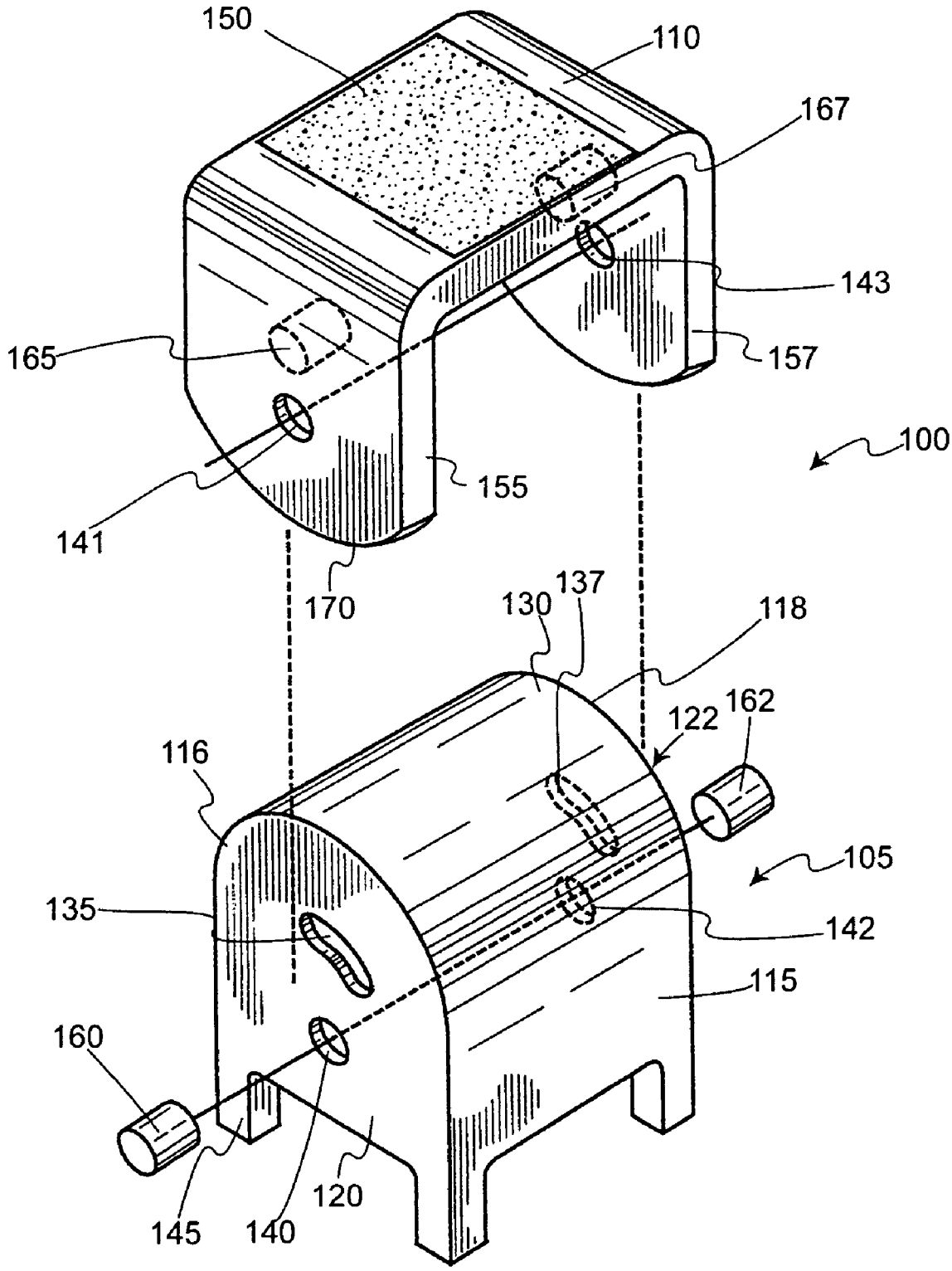
FIG. 1 is an exploded perspective view of an embodiment of the present invention.
Figure 2:
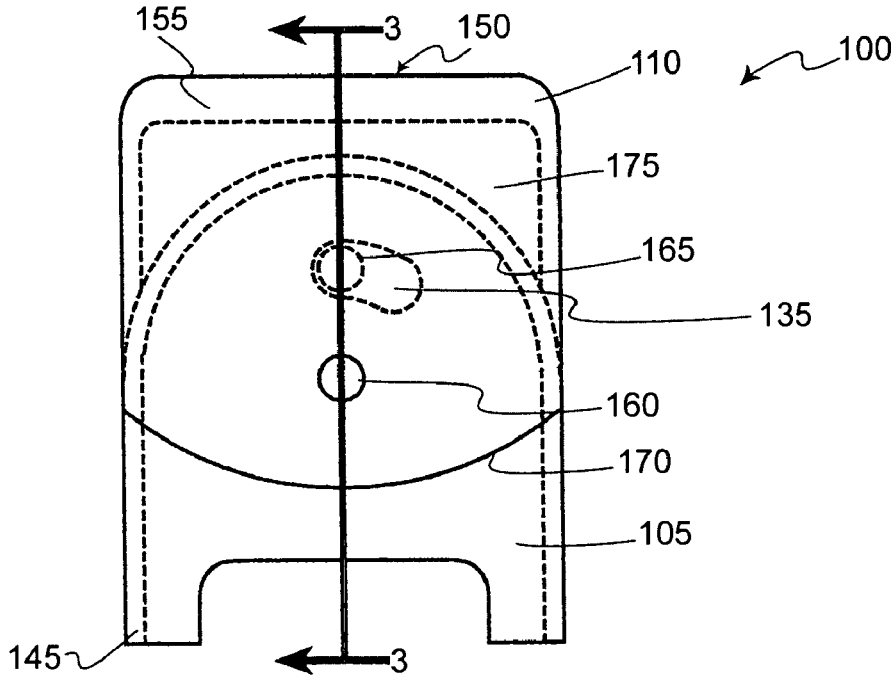
FIG. 2 is a side view of the embodiment illustrated in FIG. 1.
Figure 3:
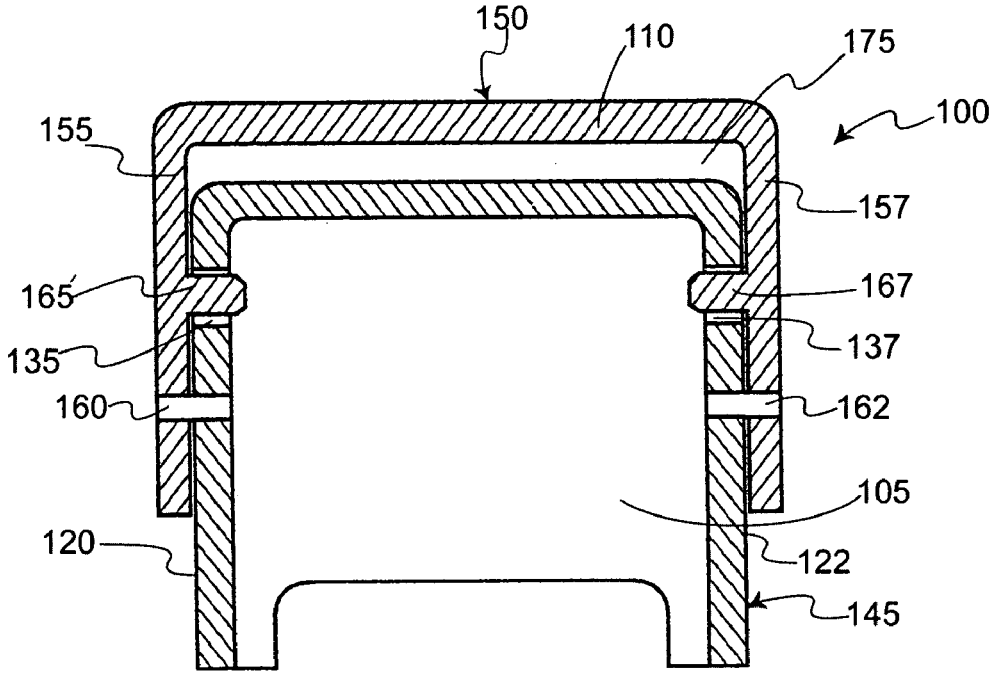
FIG. 3 is a cross-sectional view taken along line 3-3 of FIG. 2.

Referring now to the drawings submitted herewith wherein the various elements depicted therein are not necessarily drawn to scale and wherein like elements are designated with like reference numerals throughout the figures and in particular to FIGS. 1, 2 and 3, there is illustrated a preferred embodiment of a gardening chair 100 constructed according to the principles of the present invention.

The gardening chair 100 comprises a base portion 105 and a top portion 110. Base portion 105 includes a wall 115 that is contiguously formed with two opposing side walls 120 and 122 proximate lateral edges 116 and 118 of wall 115 to form base portion 105. Base portion 105 has an upper section 130 that is generally arcuate in shape. The base portion 105 includes four legs members 145 which are contiguously formed therewith and function to engage a suitable support surface such as the ground. It is contemplated within the scope of the present invention that an alternative embodiment of the present invention includes leg members 145 that are adjustable in length to facilitate adjustment of the height of the sitting surface 150. With such adjustable leg members 145, good results have been achieved utilizing leg members 145 that adjust to allow the height of chair 100 to be approximately thirteen to fifteen inches.

The upper section 130 of the base portion 105 is formed into an arcuate shape to allow the top portion 110 that is movably secured to the base portion 105 to pivot without restriction or interference from the base portion 105. While no particular radius of the upper section 130 is required, good results have been achieved utilizing a wall 115 having an upper section 130 that has approximately a six inch radius. The base portion 105 further functions to provide the structural support needed for the movably engaged top portion and a user engaged therewith. The base portion 105 is manufactured from a suitable durable material such as but not limited to plastic or aluminum. Those skilled in the art will recognize that the base portion 105 could be manufactured with numerous different amounts of walls and still be formed into a desirable shape achieving the functionality as described herein. It should also be recognized that different amounts of leg members 145 could be utilized to engage a suitable support surface.

Two pivot holes 140 and 142 are journaled through each of the two opposing side walls 120 and 122, respectively, below the center points of the side walls 120 and 122 and are generally annular in shape. Pivot holes 140 and 142 are of sufficient diameter to receive therein pivot pins 160 and 162. Pivot pins 160 and 162 (see FIG. 3) function to movably connect the top portion 110 to the base portion 105 and function to allow the top portion 110 to pivot around the base portion 105. Pivot pins 160 and 162 are shaped to be matebaly inserted into the pivot holes 140 and 142. Pivot pins 160 and 162 are manufactured from suitable durable materials such as but not limited to plastic or aluminum. It is further contemplated within the scope of the present invention that the pivot pins 160 and 162 could be manufactured as single pin of sufficient in length to fit both pivot holes 140 and 142 at the same time.

Two pivot slots 135 and 137 are positioned above pivot holes 140 and 142, respectively, and are journaled through each of the two side walls 120 and 122. The pivot slots 135 and 137 are generally arcuate in shape and are sufficient in size in order to receive pivot pins 165 and 167 of top portion 110. Pivots slots 135 and 137 function to control the movable range of the top portion 110 subsequent to being secured to the base portion 105. Pivot slots 135 and 137 are located generally parallel to each other on each of the two opposing side walls 120 and 122 to allow the top portion 110 to move without binding or restriction. The length of pivot slots 135 and 137 function to control the degrees of tilt of the movably connected top portion 110. While no particular length of pivot slots 135 and 137 is required, good results have been achieved utilizing pivot slots 135 and 137 having sufficient in length to allow the top portion 110 to rotate between a vertical upright position and a tilted position approximately twenty five degrees from vertical.

Pivot slots 135 and 137 are generally arcuate in shape and positioned so as to allow the movably connected top portion 110 to tilt in one direction a number of degrees as controlled by the length of the pivot slots 135 from an initially upright or vertical position. This tilting of the top portion 110 facilitates a user sitting on chair 100 to extend their reach therefrom. Although the pivot slots 135 are illustrated in the drawings submitted herewith as being shaped to allow the movably connected top portion 110 to tilt in one direction, it should be recognized by those skilled in the art that the pivot slots could be shaped to facilitate the tilting of the movably connected top portion 110 in two directions.

The top portion 110 includes two side members 155 and 157 with seat portion 150 interposed the two side members 155 and 157 and integrally formed therewith. The top portion 110 is manufactured of suitable durable materials such as but not limited to plastic or aluminum. The top portion 110 is of sufficient size to be superposed the base portion 105 and movably connected thereto. The bottom edge of each side members 155 and 157 is generally arcuate in shape to facilitate the top portion 110 to tilt with respect to the base portion 105 without interference or restriction from the support surface on which the garden chair 100 is placed. Those skilled in the art will recognize that the bottom edge 170 of the side members 155 could be shaped in numerous different shapes in order to achieve the functionality as described herein.

Pivot apertures 141 and 143 are journaled through each side member 155 and 157, and function to receive pivot pins 160 and 162 thereby movably securing the top portion 110 to the base portion 105. The top portion 110 is superposed on the base portion 105 such that the pivot holes 140 and 142 and the pivot apertures 141 and 143 are in general alignment in order to facilitate receiving pivot pins 160 and 162.

As illustrated in FIGS. 2 and 3 the space 175 between top portion 110 and base portion 105 allows the top portion 110 to tilt with respect to the base portion 105 as described herein substantially eliminating contact between the top portion 110 and the base 105. While no particular distance is required for the mounting space 175, good results have been achieved with a mounting space 175 that is at least one-eighth of an inch.

Mounting pins 165 and 167 are mounted generally parallel to each other and engage pivot slots 135 and 137 on side walls 120 and 122. The mounting pins 165 and 167 function to control the degree of tilting of the top portion 110 with respect to the base portion 105 as the mounting pins 165 and 167 traverse within the pivot slots 135 and 137.

A description of the operation of the gardening chair 100 is as follows. In use, a user will position the gardening chair 100 in a desired location and assume a sitting position thereon. The sitting surface 150 is configured in a substantially horizontal manner with top portion 110 being generally vertical. While performing the desired task a user can extend their reach by leaning or applying pressure to the edge of the top portion 110. As top portion 110 tilts at an angle with respect to the base portion 105 the user can extend their reach in the area proximate the gardening chair 100. The pivot rod 160 functions to facilitate the tilting or pivoting movement of the top portion 110. The user will apply pressure to the edge 185 of top portion 110 until the desired extended reach is achieved or until the mounting pin 165 and 167 engage the ends of povot slots 135 and 137. Pivot slot 135 and 137 function to control the range of movement of the top portion 110 within the range of approximately zero (being vertical) to twenty five degrees from vertical. This process is repeated as needed to reach objects or into the area proximate the gardening chair 100.

It is contemplated to be in the scope of this invention that alternative embodiments of the present invention can be made and still be within the scope of this invention. In particular in one alternative embodiment, it is contemplated that pockets or compartment areas could be incorporated into chair 100 to receive items such as tools or used for storage. Such compartment areas could include an area on one side of chair 100 or could be removable side pockets that attach with to chair 100 with hooks or tongue and groves. In yet another embodiment, it is contemplated that a locking/unlocking mechanism could be incorporated into chair 100 to permit the operating of chair such that top portion 110 could be locked in preset positions, or unlocked to permit uninhibited movement. In still yet another embodiment, it is contemplated that chair 100 could have incorporated therein a handle, such as in top portion 110, to facilitate easier handling by a user.

In the preceding detailed description, reference has been made to the accompanying drawing that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A device for supporting a user in a sitting position comprising:

a base for providing structural support, said base portion comprising a wall that is contiguously formed with two opposing side walls;

an upper section, said upper section generally arcuate in shape; and four leg members contiguously formed with the wall and two opposing sidewalls; and a top portion, said top portion including a sitting surface, said top portion pivotally connectable to said base with said top portion movable between a first position and a second position with respect to said base, said top portion including first and second support members, with each of said first and second support members being pivotally connected to said base with at least one pivot pin, wherein said first support member including a first mounting pin;

said second support member including a second mounting pin;

said base including a first slot and a second slot;

said first slot of said base for receiving said first mounting pin; and said second slot of said base for receiving said second mounting pin.

2. The device as recited in claim 1, wherein first and second mounting pins and said first and second slots facilitate the movement of said top portion between said first position and said second position.

3. The device as recited in claim 2, wherein said first and second slots are configured the movement of said top portion between said first position and said second position is 25 degrees.

4. The device as recited in claim 3, wherein said sitting surface is generally planar.

5. A chair for supporting a user in a sitting position comprising:

a base for providing structural support, said base portion comprising a wall that is contiguously formed with two opposing side walls;

an upper section, said upper section generally arcuate in shape; and four leg members contiguously formed with the wall and two opposing sidewalls; and a top portion, said top portion including a sitting surface, said top portion pivotally connectable to said base with said top portion movable between a first position and a second position with respect to said base, said top portion including first and second support members, with each of said first and second support members being pivotally connected to said base with at least one pivot pin, wherein said first support member including a first mounting pin;

said second support member including a second mounting pin;

said base including a first slot and a second slot;

said first slot of said base for receiving said first mounting pin; and said second slot of said base for receiving said second mounting pin.

6. The chair as recited in claim 5, wherein first and second mounting pins and said first and second slots facilitate the movement of said top portion between said first position and said second position.

7. The chair as recited in claim 6, wherein said first and second slots are configured the movement of said top portion between said first position and said second position is 25 degrees.

8. The chair as recited in claim 7, wherein said sitting surface is generally planar.

9. A gardening chair for providing a user increased access to the area proximate thereto comprising:

a base for providing structural support, said base portion comprising a wall that is contiguously formed with two opposing side walls;

an upper section, said upper section generally arcuate in shape; and four leg members contiguously formed with the wall and two opposing sidewalls; and a top portion connected to said base, said top portion including a sitting platform, said top portion including first and second support members extending from said sitting platform, said first and second support members being pivotally connected to said base with at least one pivot pin, wherein said first support member including a first mounting pin;

said second support member including a second mounting pin;

said base including a first slot and a second slot;

said first slot of said base for receiving said first mounting pin; and said second slot of said base for receiving said second mounting pin.

10. The gardening chair as recited in claim 9, wherein first and second mounting pins and said first and second slots facilitate the movement of said top portion between said first position and said second position.

11. The gardening chair as recited in claim 10, wherein said first and second slots are configured the movement of said top portion between said first position and said second position is at least 25 degrees.

12. The gardening chair as recited in claim 11, wherein said sitting platform is generally planar.

* * * * *